United States Patent [19]

Arrasmith

[11] 4,203,589

[45] May 20, 1980

[54] JAM DETECTOR

[75] Inventor: Fred V. Arrasmith, San Jose, Calif.

[73] Assignee: International Business Machines Corporation, Armonk, N.Y.

[21] Appl. No.: 854,918

[22] Filed: Nov. 25, 1977

[51] Int. Cl.[2] ..... B65H 43/08; B65H 7/14

[52] U.S. Cl. ..... 271/258; 271/178

[58] Field of Search ..... 271/259, 258, 177, 181, 271/178, 179, 180, 215

[56] References Cited

U.S. PATENT DOCUMENTS

| | | | |
|---|---|---|---|
| 3,136,423 | 6/1964 | Delplace et al. | 209/111.5 |
| 3,193,283 | 7/1965 | Smith | 271/47 |
| 3,390,878 | 7/1968 | MacNeill et al. | 271/259 |
| 3,778,629 | 12/1973 | Terryn | 250/557 |
| 3,779,440 | 12/1973 | Casale et al. | 226/74 |
| 3,815,895 | 6/1974 | Dufour | 270/56 |
| 3,927,878 | 12/1975 | Bolsenga et al. | 271/173 |
| 3,944,933 | 3/1976 | Gallet | 328/5 |
| 4,022,460 | 5/1977 | Pritchett | 271/258 |

*Primary Examiner*—Bruce H. Stoner, Jr.
*Assistant Examiner*—Brian Bond
*Attorney, Agent, or Firm*—Otto Schmid, Jr.

[57] ABSTRACT

A jam detector comprising a sensor for producing a first signal which indicates the presence of a document at a predetermined position in a document path and a second signal which indicates the absence of a document at the predetermined position in the document path. The presence and absence indicating signals are sampled at regular intervals of document motion along the document path and the resultant signals are applied in a preferred embodiment to a bidirectional counter to increment for presence signals and decrement for absence signals. These presence and absence signal indications are accumulated in the counter and a jam indication is produced when the accumulated count reaches a predetermined value.

12 Claims, 5 Drawing Figures

JAM DETECTOR

BACKGROUND OF THE INVENTION

This invention relates to apparatus for detecting jams in a document path and, in particular, relates to such apparatus for use in a document path associated with a high speed printer in conjunction with a data processing system.

Presently known jam detectors have not been entirely satisfactory when applied to printer devices operating with data processing systems since these printer devices are operating at higher and higher speeds and reliable paper flow becomes more critical at higher speeds. One form of prior art jam detector utilizes a resettable timing device having a timing cycle of predetermined duration. The timing control is responsive to the trailing edge of the sheet entering a processing station to reset the timing device. If the timing device is not reset within a predetermined time, then a jam condition is indicated. This type of jam detector proved to be unsatisfactory when a series of documents being fed along a document path experienced a temporary slowdown or partial jam, possibly caused by one document being fed improperly. So long as any gap remained between the sheets, the trailing edge was sensed and the timing device was reset. By the time a jam was sensed, several documents could be involved and this resulted in loss of data due to tearing of sheets backed up along the document path. Any loss of data due to damaged documents is considered unacceptable. An attempt to reduce the duration of the timing cycle resulted in a number of unnecessary jam indications since many of the cases of temporary slowdowns or partial jams cleared themselves so no real jam ever occurred. Any unnecessary lost time in a data processing system is likewise considered unacceptable.

Another type of prior art jam detector utilizes a number of sensors along a document path and the progress of the documents along the path is monitored. By considering the expected progress of the document along the path, control circuits are provided to signal a jam condition whenever the detected progress does not correspond to the expected progress. This prior art system proved unsatisfactory since it was not possible to accurately define the time for arrival at points along the sheet path with sufficient accuracy to reliably sense jams in the presence of temporary slowdowns and partial jams as discussed above.

SUMMARY OF THE INVENTION

It is therefore the principal object of this invention to provide a jam detector which is operable to determine quickly when a jam or pending jam occurs but which does not unnecessarily stop the associated system if the jam condition may clear.

In accordance with the invention, the jam detector comprises a sensing assembly to detect the presence or absence of a document at a predetermined position in the document path, means for producing pulses for a predetermined increment of document advance along the document path and a control circuit which utilizes the pulses indicating a predetermined increment of motion to sample the output of the sensing assembly and accumulating the resultant sensing assembly signals and indicating a jam indication when the accumulation level reaches a predetermined limit.

DETAILED DESCRIPTION OF THE PREFERRED EMBODIMENT

The invention is described in conjunction with apparatus for stacking documents in sequence although it will be recognized by those skilled in the art that the invention is not so limited, but is also applicable as a jam detector for other document feeding operations. In principle, this jam detector is applicable to any document feeding system in which the movement of the document along the document path is not precisely controlled so that the movement from one position to another along the document path takes a variable amount of time.

Figure 1:
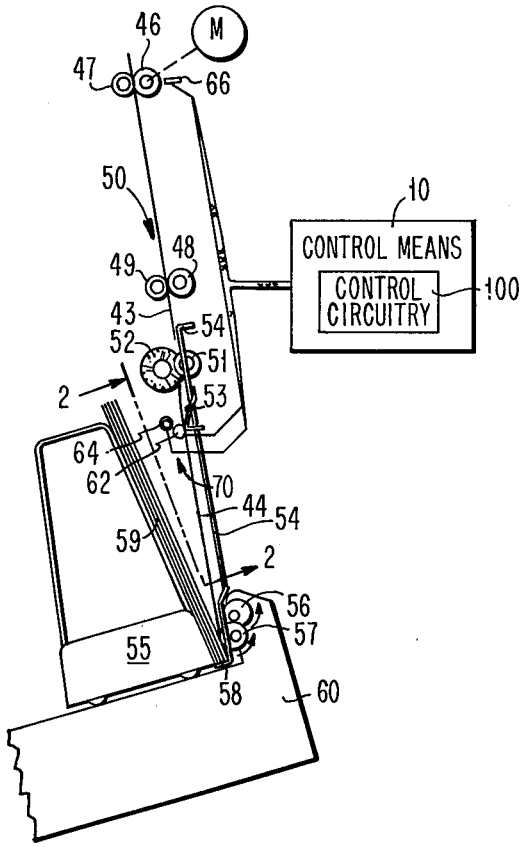
FIG. 1 is a schematic diagram illustrating the principles of the jam detector comprising the invention as applied to apparatus for stacking documents in sequence.

FIG. 1 shows the apparatus according to the invention as applied to apparatus for stacking documents in sequence. The documents, such as sheets 43 and 44 are fed under control of control means 10 along a document path 50 comprising pairs of cooperating feedrolls 46, 47; 48, 49; and 51, 52. The roll 51 is undercut alternately along its length to form sections of larger and smaller diameters. The roll 52 is made of a fuzzy, bristle-like material such as a soft fiber and resembles a brush. The roll 52 is engaged to the roll 51 such that the incoming sheet 44, under pressure from the roll 52 is temporarily "corrugated" by the alternately varying diameters of the roll 51. This temporary corrugation stiffens the sheet in the direction of travel allowing it to be driven past a plurality of springs 53 arranged across a backplate 54 in parallel relationship to each other so that only one of them is visible in this view. The backplate shown comprises a multiple of parallel wires arranged in a plane, which act in the same manner as a conventional solid member. The corrugating effect brought about by the roll 51 imparts sufficient stiffness to the documents for deflecting springs 53 without significantly altering the path of the sheet. The rolls 51 and 52 continue to drive the sheet until the trailing edge of the sheet passes through and out of engagement with these rolls. When the trailing edge of the sheet comes out of engagement with the rolls 51 and 52, the sheet is no longer able to hold the springs 53 in their deflected state. The springs 53 return to their normal undeflected state, pushing the trailing end of the sheet as they do so. As the trailing end of the sheet is pushed over, the trailing edge of the sheet comes into engagement with the fuzzy surface of the roll 52. The roll 52 moves the trailing edge of the sheet to a position out of the way of the leading edge of the next incoming sheet and also blocks any tendency of the just-stacked sheet to return into the path of the incoming sheet.

The leading edge of a sheet, after deflecting the springs 53, is guided by the backplate 54 on one surface and on the opposite surface by a backstop 55 in the case of the first sheet, or by the previously stacked sheet in all other cases. The leading edge of the sheet passes a pair of cams 56 and 57 and is stopped by a toeplate 58. The cams 56 and 57 are driven in phase with each other but may be entirely asynchronous with respect to the arrival of the sheets being stacked. The toeplate 58 provides a guiding action around the cams 56 and 57 which control the highest point that the leading edge of the sheet can contact the cams 56 and 57. The lower portion of the toeplate 58 consists of a ledge on which the most recently stacked part of a document stack 59 rests.

The cams 56 and 57 push the leading end of the sheet over to the stack. The alternate lift and fall of the cams 56 and 57 packs the lower portion of the stack 59 on the lift, and allows entry of the next sheet on the fall. The rotational speed and shape of the cams 56 and 57 is such that the stack 59 can spring back only slightly during the fall of the cams 56 and 57 and the duration of the push on stack 59 is short enough that, should a leading edge of a sheet arrive during its duration, buckling of the sheet will accommodate the slight delay of the leading edge while the bulk of the sheet maintains its velocity. This buckling is such that as the push from the cams 56 and 57 ends, the leading edge of the sheet will resume its motion past the cams 56 and 57.

The stack 59 is supported on a bed 60, as is the backstop 55, and as sheets are stacked, it is necessary for the stack 59 and the backstop 55 to move along bed 60 to provide room for the newly arriving sheets.

The jam detector according to the invention comprises a sensing assembly 70 for detecting the presence of a document at a predetermined position in the document path. A sensor 66 is provided to produce a series of electrical pulses denoting a predetermined increment of document advance along the document path. An electric control signal generating circuit 100 is provided which receives as input signals the output signals from sensing assembly 70 as sampled by the output signals from sensor 66. The resultant signals are accumulated and a jam indication signal is produced when the accumulation level reaches a predetermined limit.

Figure 2:
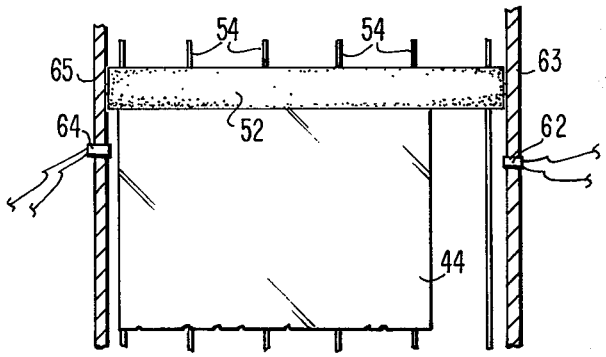
FIG. 2 is a partial cross-section view along the lines 2—2 of FIG. 1.

In the embodiment shown in the drawings, the sensing assembly comprises a light source 62 mounted in side plate 63 on one side of the document path and a light sensitive device 64 mounted on the opposite side of plate 65. Light sensitive device 64 may conveniently be a photosensitive device such as a photocell or a photoransistor. As can be seen in FIGS. 1 and 2, the position of the light source and the light sensitive device is slightly offset in both the up-and-down and side-to-side directions so that during the normal stacking operation a document will be in position to come between the light source and the light sensitive device for a finite time. Thus, the light from source 62 will not reach light sensitive device 64 during this time period so that the output from the light sensitive device 64 can be monitored to determine when documents are in the sensing zone between light source 62 and light sensitive device 64. The output of sensing assembly 70 is the signal labeled in FIG. 3 as SENSOR DARK. In normal operation the incoming sheet 44 does not go through sensing assembly 70.

The electric control circuitry 100 is designed to accept electrical control signals from the document transport system and generate a jam signal under certain conditions and circuitry 100 may conveniently be included as a part of control means 10. Control circuitry 100 is designed to accept as one input the output from the sensing assembly 70. A second input to electric control circuitry 100 is provided from sensor 66. Sensor 66 produces a series of electrical pulses the frequency of which is proportional to the speed of the document along the document path. The number of these control pulses then is proportional to the displacement of the documents along the document path. In the embodiment shown, sensor 66 comprises an emitter which is coupled to the same shaft as feedroll 46 which is driven, as shown by the dashed line in the drawing, by motor 67. The other feedrolls are also driven by motor 67 by suitable belts or gears (not shown in the drawings). The emitter in the preferred embodiment comprises a circular member having a plurality of spaced teeth members on its peripheral surface. When one of the teeth members is aligned with a magnetic pickup member, a low reluctance path is established and an electrical pulse is produced in the pickup circuit. The pulses from sensor 66 may be divided by suitable circuitry if desired to produce the signal TIMED STEP to correspond to the desired increment of paper motion along the document path.

Electric control circuitry 100 comprises suitable logic circuit controls to control counting means 103 in such a manner that jam latch 105 will be set only when a true jam condition exists along the document path and so that no false jam indications are provided. The convention used in describing the operation of the logic circuits in my specific embodiment uses the SIGNAL NAME to denote that the line is high or at its most positive level and $\overline{\text{SIGNAL NAME}}$ to denote that the line is low or at its most negative level. Electric control circuitry 100 receives as input the signal TIMED STEP from sensing means 66 and the signal SENSOR DARK which is derived from sensing assembly 70. Counting means 103 in the preferred embodiment comprises a bidirectional counter. The counter functions to increment when the $\overline{\text{TIMED STEP}}$ signal is low and the input on the SENSOR DARK line is high and to decrement when the $\overline{\text{TIMED STEP}}$ signal is low and the SENSOR DARK line is low. Thus, it can be seen that the TIMED STEP signal functions as sampling pulses and the polarity of the SENSOR DARK signal determines whether the counting means 103 is incremented or decremented at the sampling time. The controls are set up so that counting means 103 is only counted between predetermined counts. In the specific embodiment, the counter is not decremented past zero and the counter is not incremented beyond a full count. The counting means functions to provide an output on the carry/borrow line 107 when the counter is at zero and the SENSOR DARK signal is low. An output is also provided on the carry/borrow line when the counter is full and the SENSOR DARK signal is high; however, a change of the polarity of the SENSOR DARK signal will prevent the output on the carry/borrow line. Thus, it can be seen that the counter functions to accumulate counts from a series of documents moving along the document path until the counter is full, at which time the jam latch is set to indicate a jam condition to the system. Once the jam latch is set, operator intervention is required to remove the jam and produce the signal CONTROL RESET which is connected to the reset terminal of jam latch 105. The CONTROL RESET signal can be provided in any suitable manner such as by the operation of a push-button on the control panel by the machine operator.

Figure 3:
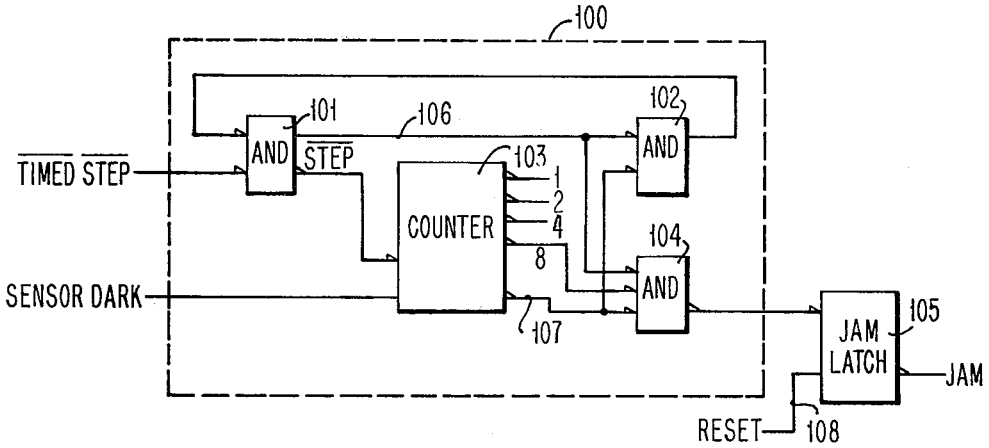
FIG. 3 is a schematic block diagram of the electric control circuitry according to the invention.
Figure 4:
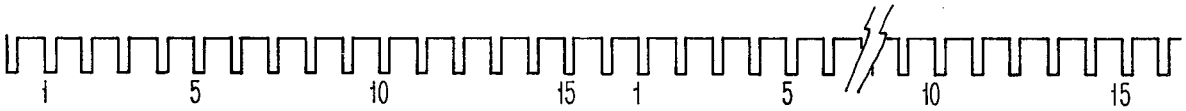
FIG. 4 is a timing diagram showing the TIMED STEP pulses which form one input to the electric control circuit of FIG. 3.

The detailed operation of the electric control circuitry 100 will now be described in conjunction with the timing diagrams shown in FIGS. 4 and 5. The pulses shown in FIG. 4 are the TIMED STEP pulses which are applied to AND circuit 101. The convention of the logic circuits shown in FIG. 3 is that the wedge means that a low or down level signal is active to produce a specified output. For example, the two inputs to AND circuit 101 are both shown with wedges so that when these inputs are coincidentally low, the signal $\overline{\text{STEP}}$ is produced at the output of AND circuit 101. This signal is provided to stepping control terminal of counting means 103. The other input to AND circuit 101 comes from the output of AND circuit 102. One input to AND circuit 102 is the STEP output (line 106) of AND circuit 101 and the other input to AND circuit 102 is the carry/borrow (line 107) from counter 103 which is not activated at the start of operations so AND circuit 102 is not conditioned at the start of operations. When this AND circuit 102 is not conditioned, then the presence of the TIMED STEP signal as shown in FIG. 3 at the input conditions AND circuit 101 to produce the $\overline{\text{STEP}}$ signal. If the SENSOR DARK signal is then high, counting means 103 is incremented, and if the SENSOR DARK signal is low at this time, then the counting means is decremented.

Figure 5:
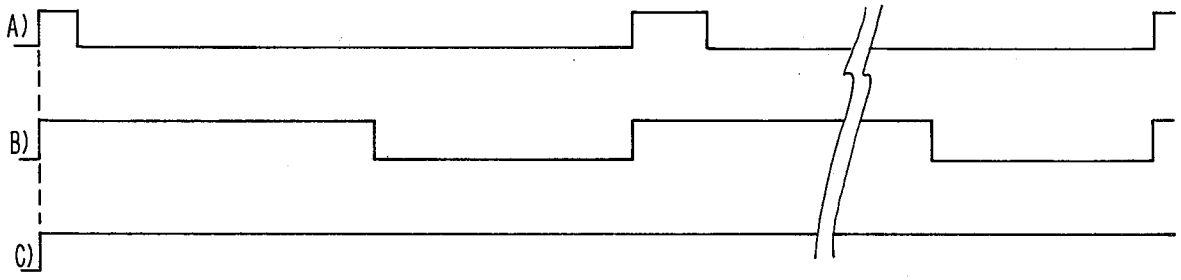
FIG. 5 is a timing diagram showing examples A, B and C, respectively, of free document flow, partially jammed flow and jammed conditions for the SENSOR DARK signals which comprise a second input to the electric control circuitry of FIG. 3.

FIGS. 4 and 5 show timing diagrams for a specific embodiment in which the signals derived from sensor 66 represent about ¾ inch of document travel along the document path. These pulses were produced by dividing the pulses produced by the emitter by a determined ratio to produce the pulses TIMED STEP shown in FIG. 4. The low level of the signal is operative to condition AND circuit 101 when AND circuit 102 is not conditioned (i.e., no output on carry/borrow line 107). FIG. 5 shows an example of free document flow along the document path. Counting means 103 is incremented for the one or two sensing intervals in which the SENSOR DARK signal is high and then decremented to zero during the remainder of the sensing periods in which the SENSOR DARK signal is low. An 11-inch document is shown in FIG. 5 so that about 15 sensing periods are provided for each sheet. Whenever a jam starts to form, the SENSOR DARK signal is up for a longer ratio of the time normally required to stack each sheet. As shown in FIG. 5*b*, counting means 103 is counted up for nine sensing periods in which the SENSOR DARK signal is high and counts down for the seven sensing periods the signal is low before the next sheet arrives. Thus, it can be seen that there is a net accumulation of count, and this condition shows the difference in operation of my invention as compared to prior art jam detectors. The light intervals would result in resetting the counter for many prior art systems with no indication of a jam starting to form. An alternative prior art system would require setting the length of time before sensing a jam short enough so that no jam is missed which may result in false jam indications in the situation shown in FIG. 5*b*. My invention takes into account the operation that sometimes occurs of a developing jam clearing itself after a few sheets so that no jam indication is produced if the impending jam clears itself before the counter reaches a predetermined count. This may take the net accumulated count from several sheets before this occurs in a situation such as shown in FIG. 5*b*. In the case shown in FIG. 5*c*, which represents a complete jam condition, the SENSOR DARK signal is high continuously so that the counter is counted up to the predetermined count to signal a jam. This is done in the embodiment shown in one sheet length so that no data is lost due to damaged documents.

If SENSOR DARK is high more than half the sensing intervals, then the count will start to accumulate. The rapidity of the accumulation is determined by the ratio of SENSOR DARk to sensor light at the sensing intervals. When there is enough accumulation of SENSOR DARK signal present that the counter steps up to a full count (16 in the specific embodiment illustrated in FIG. 3), all counter outputs and the carry output are low (active). Then during the TIMED STEP signal when the $\overline{\text{STEP}}$ line goes high, the output of AND circuit 101 (line 106) goes low and the AND circuit 104 is conditioned to set jam latch 105. When the SENSOR DARK signal is low and the counter reaches zero, the carry/borrow line is low (active); however, the EIGHT output is not low so AND circuit 104 and jam latch 105 are not energized. At this time, during the TIMED STEP pulse the AND circuit 102 is conditioned to block AND circuit 101. This condition remains until the SENSOR DARK signal goes high. The SENSOR DARK signal going high causes the output on the carry/borrow line to go high (inactive) by controls built into counting means 103 so that AND circuit 102 is deconditioned. Thus, it can be seen that the control provided by AND circuits 101 and 102 functions to prevent counting means 103 from being counted down when the counter is at zero, and from being counted up when the counter is full. When the counter is full, AND circuit 104 is conditioned and the jam latch 105 is set to produce a jam indication to the system.

Operator intervention is necessary to clear a jam along the document path. Once the jam is cleared, jam latch 105 is reset by a signal on reset line 108. The reset signal may conveniently be provided by operating a RESET button on the control panel. The jam detection circuit is then operable as before. Removal of the jam produces a low level for the SENSOR DARK signal so that the counter is decremented and AND circuit 102 is deconditioned.

While the invention has been particularly shown and described with reference to a preferred embodiment thereof, it will be understood by those skilled in the art that various changes in the form and details may be made therein without departing from the spirit and scope of the invention.

What is claimed is:

1. Apparatus for detecting jams in a series of documents moving along a predetermined document path comprising:

a sensing assembly for producing a first signal having a first state which detects the presence of a document at a predetermined position in said document path and having a second state which detects the absence of a document at the predetermined position in the document path;

means for producing pulses for each predetermined increment of document advance along the document path;

means for generating a jam signal;

an electric control signal generating circuit arrangement having first input terminals connected to said means for producing pulses and second input terminals connected to said sensing assembly and output terminals connected to said means for generating a jam signal; and circuitry intermediate said input and output terminals for accumulating said signals produced by said sensing assembly;

said circuitry comprising means for sensing the signals produced by said sensing assembly in response to each pulse for a predetermined increment of document advance along the document path and means for increasing the accumulation level in response to one of said states of said signals produced by said sensing assembly and by decreasing the accumulation level in response to said other state of said signals produced by said sensing assembly;

and means for producing an output signal to energize said means for generating a jam signal when said accumulation level reaches a predetermined limit.

2. The apparatus of claim 1 wherein said circuitry intermediate said terminals for accumulating said signals produced by said sensing assembly comprises a bidirectional counting means.

3. The apparatus of claim 2 wherein said bidirectional counting means is incremented in response to one of said states of said first signals and decremented in response to the other of said states of said first signals.

4. The apparatus of claim 3 additionally comprising means for operating said bidirectional counting means between a first and a second limit.

5. The apparatus of claim 4 wherein said first limit is zero and said second limit is a full count.

6. The apparatus of claim 5 wherein said bidirectional counting means additionally includes a carry output terminal and wherein said means for operating said counter between said zero and full counts comprising gating means responsive to the coincidental presence of an output at said carry output terminal and said other state of said first signal for blocking decrementing of said counting means and responsive to the coincidental presence of an output at said carry output terminal and said one state of said first signal for blocking incrementing of said counting means.

7. The apparatus of claim 1 wherein said sensing assembly comprises a photosensitive device.

8. Apparatus for detecting jams in a series of documents moving along a predetermined document path comprising:

a light source and photosensitive device assembly for producing a first signal having a first state which detects the presence of a document at a predetermined position in said document path and having a second state which detects the absence of a document at the predetermined position in the document path;

means for producing a series of pulses, each of said pulses defining a predetermined increment of document advance along the document path;

means for generating a jam signal;

bidirectional counting means having counting and step input terminals and count and carry output terminals;

means for coupling said first signals to said counting terminal of said counting means;

means for gating said pulses defining a predetermined increment of document advance to said step input terminal of said counting means;

said bidirectional counting means being controlled to increment in response to the simultanteous input of said step signal and one of said states of said first signal and to decrement in response to the simultaneous input of said step signal and said other state of said first signal;

means for generating an output signal when the count at said count output terminal of said counting means reaches a predetermined limit; and means for coupling said output signal to actuate said means for generating a jam signal.

9. The apparatus of claim 8 wherein said bidirectional counting means is operated between a first and a second limit.

10. The apparatus of claim 9 wherein said first limit is zero and said second limit is a full count.

11. The apparatus of claim 10 wherein said means for operating said counting means between said zero and full counts comprising gating means responsive to the coincidental presence of an output at said carry output terminal and said other state of said first signal for blocking decrementing of said counting means and responsive to the coincidental presence of an output on said carry line, and said one state of said first signal for blocking incrementing of said counting means.

12. Apparatus for detecting jams in a series of documents moving along a predetermined document path comprising:

a sensing assembly for producing a first signal having a first state which detects the presence of a document at a predetermined position in said document path and having a second state which detects the absence of a document at the predetermined position in the document path;

means for producing pulses for each predetermined increment of document advance along the document path;

means for generating a jam signal;

an electric control signal generating circuit arrangement having first input terminals connected to said means for producing pulses and second input terminals connected to said sensing assembly and output terminals connected to said means for generating a jam signal; and circuitry intermediate said input and output terminals, for sensing the signals from said sensing assembly at intervals determined by pulses from said means for producing pulses for each predetermined increment of document advance along the document path to produce a signal indication in a first direction responsive to one of said states of said first signals, and to produce a signal indication in a direction opposite to said first direction responsive to said other state of said first signals, and means to produce an output signal at said output terminals to energize said means for generating a jam signal when the net accumulation level of signal indication reaches a predetermined level.

* * * * *